US010344731B2

(12) United States Patent
Okubo et al.

(10) Patent No.: US 10,344,731 B2
(45) Date of Patent: Jul. 9, 2019

(54) FUEL PRESSURE SENSOR DIAGNOSIS DEVICE

(71) Applicant: TOYOTA JIDOSHA KABUSHIKI KAISHA, Toyota-shi, Aichi-ken (JP)

(72) Inventors: Naoya Okubo, Kariya (JP); Kazuhiro Hasegawa, Aichi-gun (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 196 days.

(21) Appl. No.: 15/481,847

(22) Filed: Apr. 7, 2017

(65) Prior Publication Data

US 2017/0298889 A1 Oct. 19, 2017

(30) Foreign Application Priority Data

Apr. 19, 2016 (JP) ..... 2016-083871

(51) Int. Cl.
*F02M 69/54* (2006.01)
*F02D 41/22* (2006.01)
(Continued)

(52) U.S. Cl.
CPC ..... *F02M 69/54* (2013.01); *F02D 41/222* (2013.01); *F02D 41/3854* (2013.01);
(Continued)

(58) Field of Classification Search
CPC .... F02M 69/54; F02M 57/005; F02D 41/222; F02D 41/3854; F02D 41/042;
(Continued)

(56) References Cited

U.S. PATENT DOCUMENTS 8,543,272 B2 9/2013 Yu et al.
9,327,706 B2 5/2016 Reed et al.
(Continued)

FOREIGN PATENT DOCUMENTS

JP 2001-107814 A 4/2001
JP 2005-226553 A 8/2005
(Continued)

OTHER PUBLICATIONS

Partial Translation of Apr. 17, 2018 Office Action issued in Japanese Patent Application No. 2016-083871.
(Continued)

*Primary Examiner* — David Hamaoui
*Assistant Examiner* — Susan E Scharpf
(74) *Attorney, Agent, or Firm* — Oliff PLC

(57) ABSTRACT

A fuel pressure sensor diagnosis device includes an electronic control unit configured to drive a fuel supply device during electric traveling of a hybrid vehicle, to perform determination as to whether an output of a fuel pressure sensor is within a normal range after driving of the fuel supply device is started, and to perform a diagnosis to determine whether a malfunction has occurred in the fuel pressure sensor based on a result of the determination, the normal range being an assumed range of the output of the fuel pressure sensor in a case where the fuel pressure sensor normally functions and the fuel supply pressure is a prescribed upper limit pressure.

4 Claims, 4 Drawing Sheets

(51) Int. Cl.

| | |
|---|---|
| ***F02M 57/00*** | (2006.01) |
| ***F02D 41/38*** | (2006.01) |
| *F02D 41/04* | (2006.01) |
| *F02D 41/30* | (2006.01) |

(52) U.S. Cl.
CPC ..... *F02M 57/005* (2013.01); *F02D 41/042* (2013.01); *F02D 41/3082* (2013.01); *F02D 2041/223* (2013.01); *F02D 2200/0602* (2013.01); *F02D 2200/501* (2013.01)

(58) Field of Classification Search
CPC ..... F02D 41/3082; F02D 2041/223; F02D 2200/0602; F02D 2200/501
USPC ..... 123/387; 701/114
See application file for complete search history.

(56) References Cited

U.S. PATENT DOCUMENTS

| | | | | |
|---|---|---|---|---|
| 9,664,166 | B2 | 5/2017 | Nagakura et al. | |
| 2009/0240417 | A1* | 9/2009 | Fushiki | F02D 41/042 701/103 |
| 2011/0118078 | A1 | 5/2011 | Kraska et al. | |
| 2011/0196594 | A1* | 8/2011 | Hasegawa | F02D 1/00 701/103 |
| 2012/0090391 | A1* | 4/2012 | Ando | F02D 41/042 73/114.43 |
| 2015/0159574 | A1 | 6/2015 | Stack et al. | |
| 2016/0040617 | A1* | 2/2016 | Nagakura | F02M 59/20 701/104 |
| 2016/0076475 | A1* | 3/2016 | Suzuki | F02M 63/0225 123/445 |
| 2016/0230693 | A1* | 8/2016 | Miyaji | F02D 41/34 |
| 2016/0281628 | A1* | 9/2016 | Miyaji | F02D 41/222 |
| 2017/0292468 | A1 | 10/2017 | Lee et al. | |
| 2017/0298889 | A1 | 10/2017 | Okubo et al. | |

FOREIGN PATENT DOCUMENTS

| | | | |
|---|---|---|---|
| JP | 2006-254628 | A | 9/2006 |
| JP | 2009-197807 | A | 9/2009 |
| JP | 2010-168901 | A | 8/2010 |
| JP | 2010-208576 | A | 9/2010 |
| JP | 2011-185158 | A | 9/2011 |
| JP | 2013-068127 | A | 4/2013 |
| JP | 2013-107539 | A | 6/2013 |
| JP | 2013-238202 | A | 11/2013 |
| JP | 2014-121976 | A | 7/2014 |
| WO | 2011/007772 | A1 | 1/2011 |

OTHER PUBLICATIONS

Nov. 24, 2017 Office Action issued in U.S. Appl. No. 15/080,854.
Mar. 29, 2018 Office Action issued in U.S. Appl. No. 15/080,854.
Nov. 23, 2018 Office Action issued in U.S. Appl. No. 15/080,854.
Mar. 27, 2019 Notice of Allowance issued in U.S. Appl. No. 15/080,854.

* cited by examiner

FUEL PRESSURE SENSOR DIAGNOSIS DEVICE

INCORPORATION BY REFERENCE

The disclosure of Japanese Patent Application No. 2016-083871 filed on Apr. 19, 2016 including the specification, drawings and abstract is incorporated herein by reference in its entirety.

BACKGROUND

1. Technical Field

The disclosure relates to a fuel pressure sensor diagnosis device configured to detect the pressure of fuel supplied to a fuel injection valve, the fuel pressure sensor diagnosis device being installed in a fuel supply system for an engine mounted in a hybrid vehicle configured to perform electric traveling with the use of power generated by a motor in a state where the rotation of an engine is stopped.

2. Description of Related Art

As a diagnosis device for a fuel supply system, a device described in Japanese Patent Application Publication No. 2011-185158 (JP 2011-185158A) is known. The fuel supply system, to which the diagnosis device described in this document is applied, includes a mechanical fuel pump that receives power from an engine to deliver fuel, and a high-pressure fuel pipe that stores the fuel delivered by the fuel pump to supply the stored fuel to a fuel injection valve. Further, the fuel supply system includes a fuel pressure sensor that detects the pressure of the fuel within the high-pressure fuel pipe, that is, the pressure (hereinafter referred to as fuel supply pressure) of the fuel supplied to the fuel injection valve by the fuel pump. In the fuel supply system including the fuel pump, the high-pressure fuel pipe, and the fuel pressure sensor, feedback control is performed on the amount of fuel delivered by the fuel pump, on the basis of a result of detection performed by the fuel pressure sensor such that the fuel supply pressure coincides with a target value. Further, the fuel pressure sensor diagnosis device described in JP 2011-185158A determines whether a malfunction has occurred in the fuel supply system on the basis of a control state of the above-described feedback control during fuel cut of the engine.

SUMMARY

As the diagnosis in the fuel supply system, it may be determined whether a fuel supply pressure detected by the fuel pressure sensor coincides with an actual fuel supply pressure, that is, the diagnosis on the rationality of the fuel pressure sensor may be performed. In the above-described diagnosis device of the related art, the diagnosis on the fuel supply system is performed during the fuel cutoff of the engine. It is desirable that the diagnosis on the rationality of the fuel pressure sensor should be performed during the fuel cutoff. That is, during the operation of the engine, the fuel pressure within the high-pressure fuel pipe drops each time fuel injection is performed, and the fuel supply pressure fluctuates constantly. Therefore, it is difficult to determine whether the fuel supply pressure detected by the fuel pressure sensor coincides with the actual fuel supply pressure. In contrast, during the fuel cutoff, the fuel injection is stopped, and the fluctuation of the fuel supply pressure due to the fuel injection does not occur. Therefore, it is possible to easily and accurately determine whether the fuel supply pressure detected by the fuel pressure sensor coincides with the actual fuel supply pressure, during the fuel cutoff.

However, in the case of the hybrid vehicle configured to perform the electric traveling with the use of the motor in a state in which the rotation of the engine is stopped, the frequency with which the fuel cutoff is performed in the engine is low as described below. Therefore, the opportunity of performing the diagnosis on the rationality of the fuel pressure sensor is limited if the diagnosis is performed during the fuel cutoff. That is, it is necessary to maintain an engine speed at a given speed or higher during the fuel cutoff to prevent engine stall when the fuel injection is restarted. Thus, a given amount of energy is consumed to maintain the engine speed even during the fuel cutoff. In this case, if the traveling is switched to the electric traveling with the use of the motor, the consumption of energy for maintaining the engine speed becomes unnecessary, and the energy efficiency of the vehicle becomes high. Therefore, in the hybrid vehicle that can perform the electric traveling, the frequency, with which the fuel cutoff is performed, is low. Thus, if the diagnosis on the fuel pressure sensor is performed during the fuel cutoff, the opportunity of this diagnosis is limited.

The disclosure provides a fuel pressure sensor diagnosis device that can appropriately secure the opportunity of performing a diagnosis on a fuel pressure sensor in a hybrid vehicle that performs electric traveling.

An aspect of the disclosure relates to a fuel pressure sensor diagnosis device configured to perform a diagnosis on a fuel pressure sensor provided in a fuel supply system including a fuel supply device configured to be driven with use of electric power to supply fuel to a fuel injection valve of an engine, and a pressure-regulating unit configured to maintain a fuel supply pressure to a prescribed upper limit pressure or lower, the fuel supply pressure being a pressure of the fuel supplied to the fuel injection valve by the fuel supply device, the fuel pressure sensor being configured to detect the fuel supply pressure, the engine being mounted on a hybrid vehicle including the engine and a motor as power sources for causing the hybrid vehicle to travel, and configured to perform electric traveling with use of power from the motor in a state where rotation of the engine is stopped. The fuel pressure sensor diagnosis device includes an electronic control unit configured to drive the fuel supply device during the electric traveling of the hybrid vehicle, to perform determination as to whether an output of the fuel pressure sensor is within a normal range after driving of the fuel supply device is started, and to perform the diagnosis to determine whether a malfunction has occurred in the fuel pressure sensor based on a result of the determination, the normal range being an assumed range of the output of the fuel pressure sensor in a case where the fuel pressure sensor normally functions and the fuel supply pressure is the prescribed upper limit pressure. The assumed range may be set to, for example, a range of values within an allowable tolerance range from an assumed value of the output of the fuel pressure sensor in the case where the fuel pressure sensor normally functions and the fuel supply pressure is the upper limit pressure, the allowable tolerance range being determined based on, for example, required detection accuracy.

In the fuel pressure sensor diagnosis device, the electronic control unit drives the fuel supply device during the electric traveling of the hybrid vehicle. Since the rotation of the engine is stopped at this time, and there is no fuel consumption caused by the fuel injection of the fuel injection valve, the fuel supply pressure increases gradually in accordance with the supply of the fuel to the fuel injection valve by the fuel supply device. The fuel supply system includes the pressure-regulating unit configured to maintain the fuel supply pressure to the upper limit value or lower, and thus, the fuel supply pressure at this time increases until the fuel supply pressure reaches the upper limit pressure, and is maintained at the upper limit pressure thereafter. Therefore, the fuel supply pressure becomes the upper limit pressure after a given time has elapsed after the driving of the fuel supply device is started. As a result, when the fuel pressure sensor normally functions, the output of the fuel pressure sensor at this time should have a value corresponding to the upper limit pressure.

In the fuel pressure sensor diagnosis device, the electronic control unit is configured to perform the determination as to whether the output of the fuel pressure sensor is within the normal range after the driving of the fuel supply device is started, and to perform the diagnosis to determine whether a malfunction has occurred in the fuel pressure sensor, based on the result of the determination. As described above, when the fuel pressure sensor normally functions, the output of the fuel pressure sensor should have a value within the normal range (i.e., should fall within the normal range) eventually after the driving of the fuel supply device is started. Therefore, when the output of the fuel pressure sensor is within the normal range, it can be determined that the output of the fuel pressure sensor coincides with an actual fuel supply pressure. Thus, it is possible to perform the diagnosis to determine whether the malfunction has occurred in the fuel pressure sensor (i.e., it is possible to determine whether the malfunction has occurred in the fuel pressure sensor), based on the result of the above-described determination.

According to the above aspect, the diagnosis on the fuel pressure sensor can be performed during the electric traveling in which the rotation of the engine is stopped. In the hybrid vehicle that performs the electric traveling, when the diagnosis is performed during the electric traveling that is expected to be performed with a higher frequency than the frequency of the fuel cutoff, the opportunity of performing the diagnosis is easily secured. Thus, with the above fuel pressure sensor diagnosis device, it is possible to appropriately secure the opportunity of performing the diagnosis on the fuel pressure sensor in the hybrid vehicle that performs the electric traveling.

In a case where the diagnosis is not performed during the electric traveling, the fuel supply device is stopped in response to the stop of the rotation of the engine. Therefore, when the fuel supply device is driven for the diagnosis during the electric traveling, an occupant may feel a sense of discomfort due to the driving sound of the fuel supply device. A background noise due to the traveling of the vehicle, such as wind noise or road noise, increases with an increase in the traveling speed. Thus, the electronic control unit in the fuel pressure sensor diagnosis device may be configured to drive the fuel supply device for the diagnosis on the condition that the traveling speed of the hybrid vehicle is equal to or higher than the prescribed value. With this configuration, the driving sound of the fuel supply device at the time of the diagnosis can be made indistinguishable from the background noise, and the occupant is unlikely to feel the sense of discomfort caused by this driving sound.

In the above fuel pressure sensor diagnosis device, the electronic control unit performs the diagnosis to determine whether the malfunction has occurred in the fuel pressure sensor based on the result of the determination as to whether the output of the fuel pressure sensor is within the prescribed normal range. However, for example, in a case where the amount of electric power used in the hybrid vehicle increases rapidly and a voltage input to the fuel pressure sensor drops temporarily, the output of the fuel pressure sensor may temporarily fluctuate. Therefore, if the diagnosis is performed based on a result of the determination performed once, the result of the determination using the output at the time when the output temporarily fluctuates may be reflected on the diagnosis result (in other words, the diagnosis result may be based on the determination using the output at the time when the output temporarily fluctuates), and accordingly, an erroneous diagnosis may be made (in other words, an erroneous determination as to whether the malfunction has occurred in the fuel pressure sensor may be made). Thus, the electronic control unit may be configured to perform the diagnosis to determine whether the malfunction has occurred in the fuel pressure sensor, based on results of the determination performed a plurality of times. With this configuration, it is possible to reduce the erroneous diagnosis.

The electronic control unit may be configured to perform the determination at prescribed time intervals after the driving of the fuel supply device is started, to determine that the malfunction has occurred in the fuel pressure sensor in a case where the number of times of deviation reaches a prescribed number of times for malfunction determination before the number of times of the determination reaches a prescribed number of times, and to determine that the fuel pressure sensor normally functions in a case where the number of times of the determination reaches the prescribed number of times before the number of times of deviation reaches the prescribed number of times for malfunction determination, the number of times of deviation being the number of times the electronic control unit has determined that the output of the fuel pressure sensor is not within the normal range.

BRIEF DESCRIPTION OF THE DRAWINGS

Features, advantages, and technical and industrial significance of exemplary embodiments of the disclosure will be described below with reference to the accompanying drawings, in which like numerals denote like elements, and wherein.

DETAILED DESCRIPTION OF EMBODIMENTS

Hereinafter, a fuel pressure sensor diagnosis device according to an embodiment will be described in detail with reference to FIGS. 1 to 6. A fuel pressure sensor, on which the fuel pressure sensor diagnosis device according to the present embodiment performs a diagnosis, is installed in a fuel system for an engine mounted on a plug-in hybrid vehicle in which a high-voltage battery can be charged from an external power source.

Figure 1:
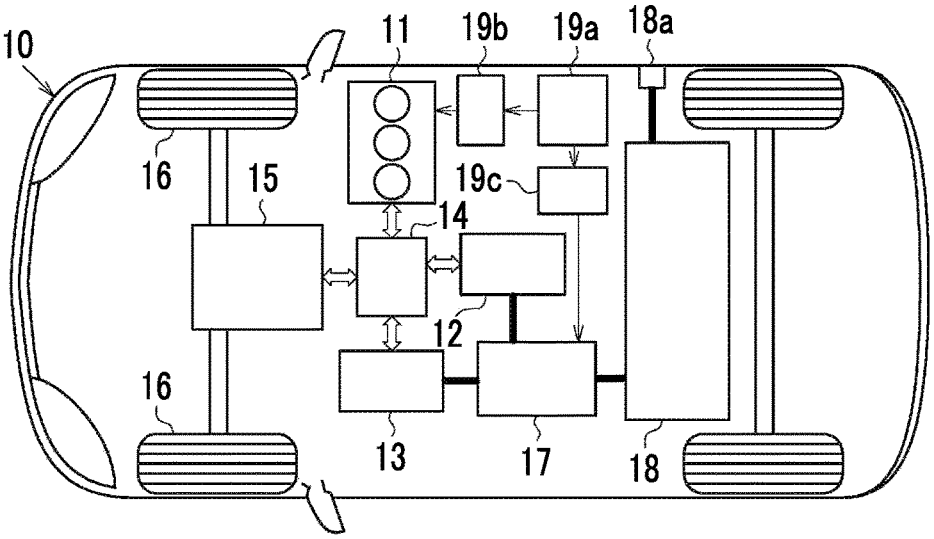
FIG. 1 is a view schematically illustrating the configuration of a drive system of a hybrid vehicle, in which a fuel pressure sensor diagnosis device according to an embodiment is provided.

As illustrated in FIG. 1, a drive system of a hybrid vehicle 10 includes an engine 11 in which fuel is combusted to generate power. The drive system includes two generator motors (a first generator motor 12, a second generator motor 13) that generate power in accordance with supply of electric power and receive power from the outside to generate electric power. The engine 11, the first generator motor 12, and the second generator motor 13 are drivingly connected to each other via a power split mechanism 14 including a planetary gear. An output side of the power split mechanism 14 is connected to drive wheels 16 of the hybrid vehicle 10 via a speed reducing mechanism 15.

Each of the first generator motor 12 and the second generator motor 13 is electrically connected to a high-voltage battery 18 via an inverter 17. The inverter 17 converts the direct current from the high-voltage battery 18 into an alternating current to supply the alternating current to the first generator motor 12 or the second generator motor 13, and converts an alternating current generated by the first generator motor 12 or the second generator motor 13 into a direct current to supply the direct current to the high-voltage battery 18. In addition, the hybrid vehicle 10 is provided with an inlet 18*a* for charging used to connect the high-voltage battery 18 to the external power source.

In the hybrid vehicle 10, the first generator motor 12 mainly performs electric power generation with the use of the power from the engine 11. Further, the first generator motor 12 functions as a starter motor at the time of start-up of the engine 11.

The second generator motor 13 mainly functions as a motor for traveling that generates the power for the traveling of the hybrid vehicle 10. In addition to this, the second generator motor 13 may perform electric power generation with a regeneration brake at the time of vehicle deceleration. In the hybrid vehicle 10, the second generator motor 13 functions as a motor serving as a power source for causing the hybrid vehicle 10 to travel.

The drive system of the hybrid vehicle 10 further includes a power control unit 19*a*. The power control unit 19*a* calculates required outputs of the engine 11, the first generator motor 12, and the second generator motor 13, in accordance with the driving condition of the hybrid vehicle 10 and/or the charge condition of the high-voltage battery 18, and transmits the calculated required outputs to an engine control unit 19*b* and an MG control unit 19*c*. The engine control unit 19*b* controls the output of the engine 11 in accordance with the received required output of the engine 11. Further, the MG control unit 19*c* drives the inverter 17 to control the first generator motor 12 and the second generator motor 13, in accordance with the received required outputs of the first generator motor 12 and the second generator motor 13. The first generator motor 12 and the second generator motor 13 perform power operation to generate power in a case where the required outputs are positive values, and perform regenerative operation to generate electric power in a case where the required outputs are negative values.

In the hybrid vehicle 10, in a case where the charge amount of the high-voltage battery 18 is equal to or higher than a prescribed value at the time of vehicle start or low-speed traveling, the rotation of the engine 11 is stopped and the hybrid vehicle 10 travels with the use of the power that is generated by the second generator motor 13 with the use of the electric power supplied from the high-voltage battery 18, that is, the hybrid vehicle 10 performs electric traveling. The power control unit 19*a* in this case sets the required outputs of the engine 11 and the first generator motor 12 to 0, and sets the required output of the second generator motor 13 such that the total drive power for the hybrid vehicle 10 is supplied with the use of only the power from the second generator motor 13. In addition, the power control unit 19*a* transmits an EV mode signal Sev indicating that the electric traveling is performed, to the engine control unit 19*b*, while the electric traveling is performed.

Figure 2:
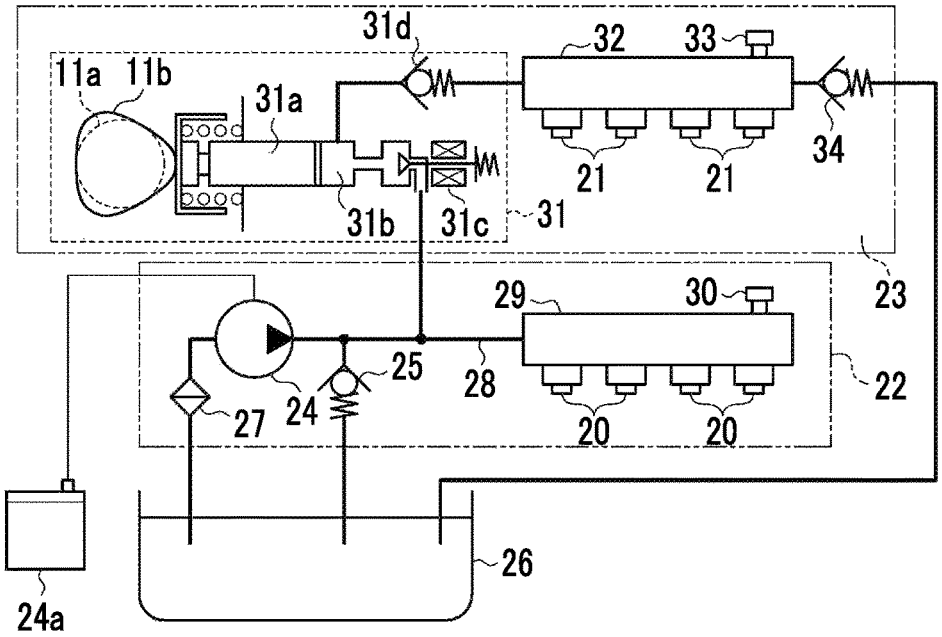
FIG. 2 is a view schematically illustrating the configuration of a fuel supply system provided with a fuel pressure sensor on which the fuel pressure sensor diagnosis device performs a diagnosis.

The configuration of the fuel supply system for the engine 11 is illustrated in FIG. 2. A port injection valve 20 and an in-cylinder injection valve 21 are provided for each cylinder of the engine 11. The port injection valve 20 is a fuel injection valve that injects fuel into an intake port, and the in-cylinder injection valve 21 is a fuel injection valve that injects fuel into the cylinder. FIG. 2 illustrates a case where the engine 11 includes four cylinders, and FIG. 2 illustrates four port injection valves 20 and four in-cylinder injection valves 21. Two fuel supply systems are provided for the engine 11. The two fuel supply systems include a low-pressure side fuel supply system 22 and a high-pressure side fuel supply system 23. The low-pressure side fuel supply system 22 supplies fuel to the port injection valves 20, and the high-pressure side fuel supply system 23 supplies fuel to the in-cylinder injection valves 21.

The low-pressure side fuel supply system 22 includes an electric feed pump 24 and a pressure regulator 25. The electric feed pump 24 is driven with the use of the electric power supplied from a low-voltage battery 24*a* whose output voltage is lower than that of the high-voltage battery 18 (FIG. 1), to pump up the fuel stored in a fuel tank 26 via a filter 27 that filters impurities in the fuel. Then, the electric feed pump 24 supplies the pumped-up fuel to a low-pressure side delivery pipe 29 to which the port injection valve 20 for each cylinder is connected, via a low-pressure fuel passage 28. The low-pressure side delivery pipe 29 is provided with a low-pressure side fuel pressure sensor 30 configured to detect the pressure of the fuel stored in the low-pressure side delivery pipe 29, that is, the pressure (fuel supply pressure) of the fuel supplied to each port injection valve 20 by the electric feed pump 24. The low-pressure side fuel pressure sensor 30 outputs a detection signal whose voltage varies in accordance with the fuel supply pressure. Thus, the fuel supply pressure can be determined based on the voltage (hereinafter, referred to as an output voltage Vpf) of the detection signal.

The pressure regulator 25 is opened to return the fuel within the low-pressure fuel passage 28 to the fuel tank 26, when the pressure of the fuel within the low-pressure fuel passage 28 exceeds a prescribed regulator set pressure P1. Accordingly, the pressure regulator 25 maintains the pressure of the fuel, which is supplied by the electric feed pump 24 to the port injection valves 20 through the low-pressure fuel passage 28, at the regulator set pressure P1 or lower, the regulator set pressure P1 being a prescribed upper limit pressure. In the following, the fuel supply pressure of the electric feed pump 24 for the port injection valves 20 is referred to as a feed pressure PF.

The high-pressure side fuel supply system 23 includes a mechanical high-pressure fuel pump 31. The high-pressure fuel pump 31 is driven with the use of the power from the engine 11, pressurizes the fuel sucked from the low-pressure fuel passage 28, and delivers the pressurized fuel to a high-pressure side delivery pipe 32 to which the in-cylinder injection valve 21 for each cylinder is connected.

In more detail, the high-pressure fuel pump 31 includes a plunger 31*a*, a pressurizing chamber 31*b*, an electromagnetic spill valve 31*c*, and a check valve 31*d*. The plunger 31*a* is reciprocated by a cam 11*b* provided on a cam shaft 11*a* of the engine 11, and changes the volume of the pressurizing chamber 31*b* in accordance with the reciprocating operation. The electromagnetic spill valve 31*c* is closed due to energization to cut off the flow of the fuel between the pressurizing chamber 31*b* and the low-pressure fuel passage 28, and is opened due to stop of the energization to allow the fuel to flow between the pressurizing chamber 31*b* and the low-pressure fuel passage 28. The check valve 31*d* allows the discharge of fuel from the pressurizing chamber 31*b* to the high-pressure side delivery pipe 32, and prevents a back flow of the fuel from the high-pressure side delivery pipe 32 to the pressurizing chamber 31*b*.

In the high-pressure fuel pump 31, the electromagnetic spill valve 31*c* is opened to suck the fuel within the low-pressure fuel passage 28 to the pressurizing chamber 31*b*, when the plunger 31*a* moves to increase the volume of the pressurizing chamber 31*b*. Then, in the high-pressure fuel pump 31, the electromagnetic spill valve 31*c* is closed to pressurize the fuel sucked to the pressurizing chamber 31*b* and to discharge the pressurized fuel to the high-pressure side delivery pipe 32, when the plunger 31*a* moves to reduce the volume of the pressurizing chamber 31*b*. In addition, the fuel discharge rate of the high-pressure fuel pump 31 is adjusted by changing the ratio of a period during which the electromagnetic spill valve 31*c* is closed, in a period during which the plunger 31*a* moves to reduce the volume of the pressurizing chamber 31*b*.

The high-pressure side delivery pipe 32 is provided with a high-pressure side fuel pressure sensor 33 configured to detect the pressure of the fuel within the high-pressure side delivery pipe 32. The high-pressure side fuel supply system 23 is provided with a relief valve 34 that is opened to return the fuel within the high-pressure side delivery pipe 32 to the fuel tank 26, when the pressure of the fuel within the high-pressure side delivery pipe 32 exceeds a prescribed relief pressure.

In the hybrid vehicle 10, when the electric traveling is started, the operation of the electric feed pump 24 (supply of electric power to the electric feed pump 24) is stopped to reduce electric power consumption. Then, when the electric traveling is ended and the operation of the engine 11 is restarted, the operation of the electric feed pump 24 (supply of electric power to the electric feed pump 24) is restarted.

The fuel pressure sensor diagnosis device of the present embodiment performs a diagnosis on the low-pressure side fuel pressure sensor 30 provided in the low-pressure side fuel supply system 22. In other words, the fuel pressure sensor diagnosis device of the present embodiment determines whether a malfunction has occurred in the low-pressure side fuel pressure sensor 30. In the fuel pressure sensor diagnosis device of the present embodiment, the electric feed pump 24 may be regarded as a fuel supply device configured to be driven with the use of electric power to supply fuel to the port injection valves 20 that are fuel injection valves of the engine 11. The pressure regulator 25 may be regarded as a pressure-regulating unit configured to maintain the fuel supply pressure (feed pressure PF) to the regulator set pressure P1 or lower, the fuel supply pressure being the pressure of the fuel supplied to the fuel injection valves (port injection valves 20) by the fuel supply device (electric feed pump 24), and the regulator set pressure P1 being the prescribed upper limit pressure.

Figure 3:
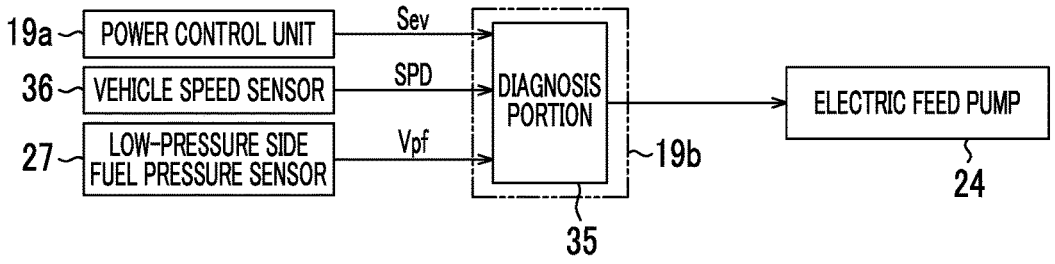
FIG. 3 is a view schematically illustrating the configuration of the fuel pressure sensor diagnosis device.

FIG. 3 illustrates the configuration of the fuel pressure sensor diagnosis device of the present embodiment. As illustrated in FIG. 3, the fuel pressure sensor diagnosis device includes a diagnosis portion 35. The diagnosis portion 35 is provided in the engine control unit 19*b*, and is configured to perform a self-diagnosis on the engine 11. In other words, the diagnosis portion 35 is implemented by an electronic control unit (ECU). The ECU includes a memory that stores data and programs, and a central processing unit (CPU) that executes the programs. The diagnosis portion 35 performs a malfunction diagnosis on the low-pressure side fuel pressure sensor 30 (in other words, the diagnosis portion 35 determines whether a malfunction has occurred in the low-pressure side fuel pressure sensor 30, that is, the ECU determines whether a malfunction has occurred in the low-pressure side fuel pressure sensor 30) as a part of the self-diagnosis on the engine 11.

The diagnosis portion 35 receives the EV mode signal Sev from the power control unit 19*a*, receives a detection signal indicating a traveling speed SPD of the hybrid vehicle 10 from a vehicle speed sensor 36 installed in the hybrid vehicle 10, and receives the output voltage Vpf of the low-pressure side fuel pressure sensor 30 from the low-pressure side fuel pressure sensor 30. Further, the diagnosis portion 35 controls the amount of electric power supplied to the electric feed pump 24. When the supply of electric power is stopped by the diagnosis portion 35, the electric feed pump 24 is also stopped. Further, when the amount of electric power supplied to the electric feed pump 24 is increased by the diagnosis portion 35, the fuel discharge rate of the electric feed pump 24 is also increased.

Figure 4:
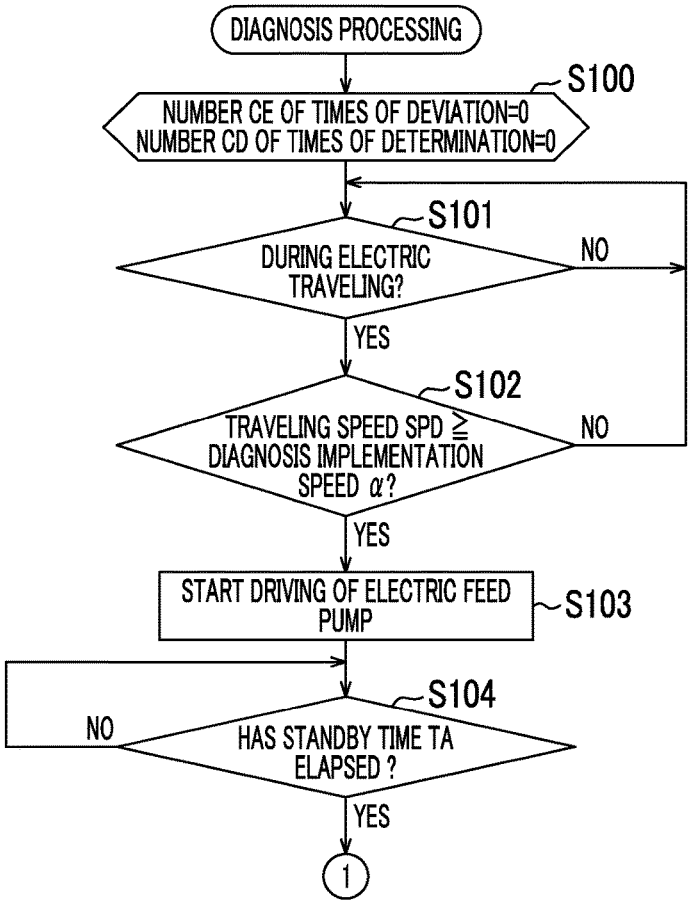
FIG. 4 is a flowchart illustrating a portion of a processing procedure of diagnosis processing executed in the fuel pressure sensor diagnosis device.
Figure 5:
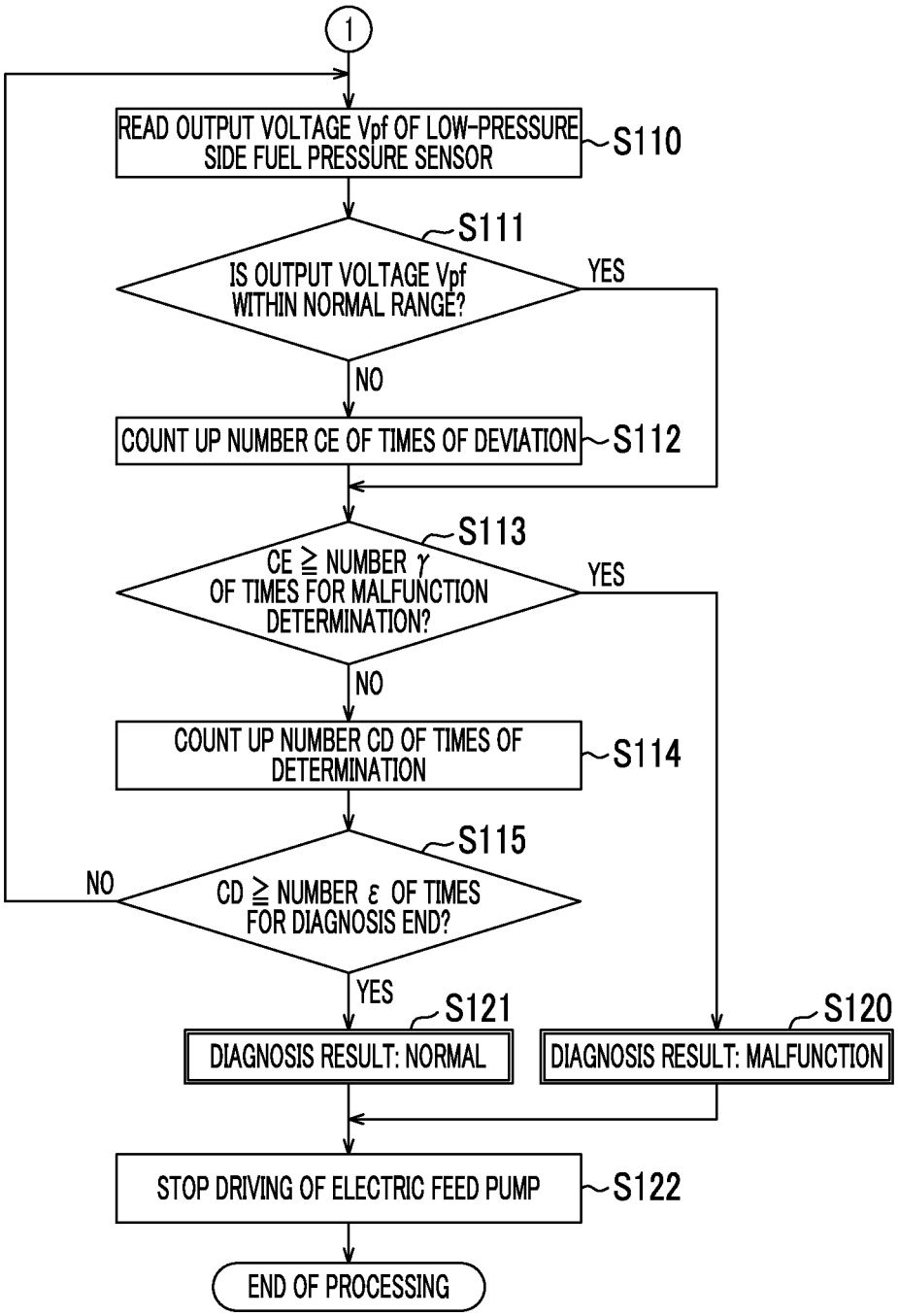
FIG. 5 is a flowchart illustrating a remaining portion of the processing procedure of the diagnosis processing.

Hereinafter, the diagnosis on the low-pressure side fuel pressure sensor 30 performed by the diagnosis portion 35 will be described. A flowchart of the diagnosis processing is illustrated in FIGS. 4 and 5. The diagnosis portion 35 starts the processing after the completion of start-up of the engine control unit 19*b*. The power control unit 19*a*, the engine control unit 19*b*, and the MG control unit 19*c* are started when an ignition switch is turned on, and are stopped when the ignition switch is turned off.

When the processing is started, first, in Step S100, the number CE of times of deviation and the number CD of times of determination, which are counters used for the diagnosis, are initialized to 0. The details of these counters will be described below.

Subsequently, in Step S101, the diagnosis portion 35 determines whether the hybrid vehicle 10 performs electric traveling (i.e., the hybrid vehicle 10 is in the electric traveling state) and whether the EV mode signal Sev is input from the power control unit 19*a*. Further, in Step S102, the diagnosis portion 35 determines whether the traveling speed SPD is equal to or higher than a prescribed diagnosis implementation speed $\alpha$. The diagnosis implementation speed $\alpha$ is set to a lower limit of the traveling speed SPD, at or above which background noise due to the traveling of a vehicle, such as a wind noise or a road noise, becomes larger than the driving sound of the electric feed pump 24 within a vehicle cabin.

In a case where a negative determination is made (NO) in any one of Step S101 and Step S102, the processing is returned to Step S101 after a time equivalent to a prescribed time interval TB has elapsed. In a case where positive determinations are made (YES) in Step S101 and Step S102, the processing is advanced to Step S103.

When the processing is advanced to Step S103, the diagnosis portion 35 starts the driving of the electric feed pump 24 (i.e., starts the operation of the electric feed pump 24), which has been stopped along with the start of the electric traveling. At this time, the electric feed pump 24 is driven in a state where the amount of electric power supplied to the electric feed pump 24 is increased to its upper limit. That is, at this time, the electric feed pump 24 is driven such that the fuel discharge rate is the maximum value.

Then, after a prescribed standby time TA has passed (i.e., has elapsed) from the start of the driving of the electric feed pump 24 in Step S104, the processing is advanced to Step S110 (hereinafter, refer to FIG. 5). The standby time TA is set to the driving time of the electric feed pump 24, during which the feed pressure PF can be reliably increased to the regulator set pressure P1 even in a case where the feed pressure PF before the driving of the electric feed pump 24 is started is at a lower limit in an assumed change range of the feed pressure PF during the electric traveling.

When the processing is advanced to Step S110, the diagnosis portion 35 reads the output voltage Vpf of the low-pressure side fuel pressure sensor 30 at the current time. In the subsequent Step S111, the diagnosis portion 35 determines whether the read output voltage Vpf has a value within a normal range, that is, whether the read output voltage Vpf is within the normal range. The normal range is set as an assumed range of the output voltage Vpf in a case where the low-pressure side fuel pressure sensor 30 normally functions (i.e., the low-pressure side fuel pressure sensor 30 is in a normal state) and the feed pressure PF of the low-pressure side fuel pressure sensor 30 is the regulator set pressure P1. Specifically, the normal range is set to a range of values within a prescribed allowable tolerance β from an assumed value Vt of the output voltage Vpf at the time when the feed pressure PF is the regulator set pressure P1, that is, a range of "Vt−β" or more and "Vt+β" or less (i.e., a range of "Vt−β" to "Vt+β"). Further, the value of the allowable tolerance β is determined according to the required detection accuracy of the low-pressure side fuel pressure sensor 30.

When the output voltage Vpf of the low-pressure side fuel pressure sensor 30 has a value within the normal range (YES), the processing is advanced to Step S113. When the output voltage Vpf has a value that is not within the normal range (i.e., when the output voltage Vpf is not within the normal range) (NO), the number CE of times of deviation is counted up in Step S112, and then, the processing is advanced to Step S113. The number CE of times of deviation is a counter for counting the number of times the diagnosis portion 35 has determined that the output voltage Vpf is not within the normal range in the current diagnosis.

When the processing is advanced to Step S113, the diagnosis portion 35 determines whether the number CE of times of deviation is equal to or larger than a prescribed number γ of times for malfunction determination. When the number CE of times of deviation is smaller than the number γ of times for malfunction determination (NO), the number CD of times of determination is counted up in Step S114, and then, the processing is advanced to Step S115. The number CD of times of determination is a counter for counting the number of times the determination at Step S111 has been performed in the current diagnosis. Then, in the subsequent Step S115, the diagnosis portion 35 determines whether the number CD of times of determination is equal to or larger than a prescribed number ε of times for diagnosis end. When the number CD of times of determination is smaller than the number ε of times for diagnosis end (NO), the processing is returned to Step S110 after the time equivalent to the above-described time interval TB has elapsed. That is, the processing from Step S110 to Step S115 forms a loop, and is repeatedly executed at the prescribed time intervals TB until the processing leaves the loop due to positive determination in Step S113 or Step S115.

In a case where the number CE of times of deviation reaches the number γ of times for malfunction determination (S113:YES) before the number CD of times of determination reaches the number ε of times for diagnosis end, the processing is advanced to Step S120. In the Step S120, the diagnosis portion 35 determines that a malfunction has occurred in the low-pressure side fuel pressure sensor 30. Then, the diagnosis portion 35 stops the driving of the electric feed pump 24 in Step S122, and then, the current diagnosis processing is ended. At this time, the diagnosis portion 35 stores the history indicating that it is determined that a malfunction has occurred in the low-pressure side fuel pressure sensor 30, in the memory of the engine control unit 19*b*. Thereafter, the engine control unit 19*b* performs fail-safe processing in order to control the engine 11 without using the result of detection performed by the low-pressure side fuel pressure sensor 30 in which a malfunction has occurred.

In a case where the number CD of times of determination reaches the number ε of times for diagnosis end (S115:YES) before the number CE of times of deviation reaches the number γ of times for malfunction determination, the processing is advanced to Step S121. In the Step S121, the diagnosis portion 35 determines that the low-pressure side fuel pressure sensor 30 normally functions. Then, the diagnosis portion 35 stops the driving of the electric feed pump 24 in Step S122, and then, the current diagnosis processing is ended. At this time, the diagnosis portion 35 stores the history indicating that it is determined that the low-pressure side fuel pressure sensor 30 normally functions, in the memory of the engine control unit 19*b*.

The diagnosis portion 35 stops the driving of the electric feed pump 24 and then restarts the processing from the beginning, in a case where the electric traveling is ended and the operation of the engine 11 is restarted or the traveling speed SPD becomes lower than the diagnosis implementation speed α, during a period from the driving of the electric feed pump 24 is started in Step S103 until the processing is ended.

The diagnosis on the low-pressure side fuel pressure sensor 30 in the diagnosis processing is performed one time each time the engine control unit 19*b* is started up, that is, one time in each trip of the hybrid vehicle 10 from the ignition switch is turned on until the ignition switch is turned off. In a case where the diagnosis is performed a plurality of times in one trip, the diagnosis processing may be executed the plurality of times in one trip.

Figure 6:
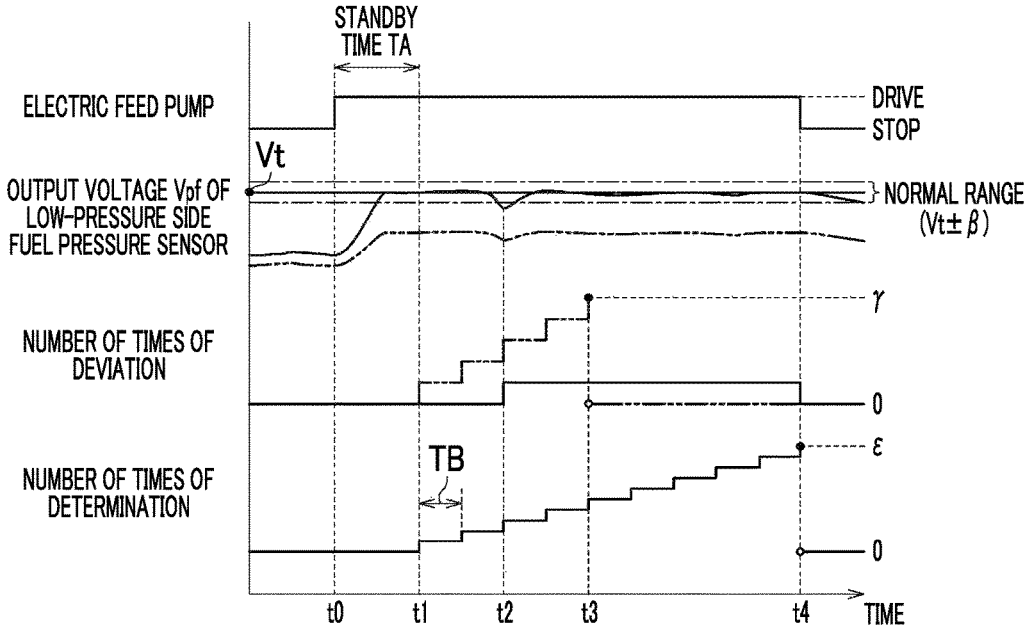
FIG. 6 is a time chart illustrating a manner in which the fuel pressure sensor diagnosis device performs the diagnosis on the fuel pressure sensor.

Subsequently, the operation of the fuel pressure sensor diagnosis device of the present embodiment configured as described above will be described. FIG. 6 illustrates a manner in which the fuel pressure sensor diagnosis device of the present embodiment performs a diagnosis on the low-pressure side fuel pressure sensor 30 (in other words, a manner in which the fuel pressure sensor diagnosis device of the present embodiment determines whether a malfunction has occurred in the low-pressure side fuel pressure sensor 30). In FIG. 6, solid lines indicate the output voltage Vpf and a change in the number CE of times of deviation when the low-pressure side fuel pressure sensor 30 normally functions. Further, in FIG. 6, alternate long and two short dashes line indicate the output voltage Vpf and changes in the number CE of times of deviation when a malfunction has occurred in the low-pressure side fuel pressure sensor 30.

When the electric traveling of the hybrid vehicle 10 at traveling speed SPD equal to or higher than the diagnosis implementation speed α is started at time t0, the driving of the electric feed pump 24, which has been stopped along with the start of the electric traveling, is started at time t1. Since the engine 11 is in a stopped state at this time, and the fuel within the low-pressure side delivery pipe 29 is not consumed by the fuel injection of the port injection valves 20, the feed pressure PF increases gradually in accordance with the driving of the electric feed pump 24 (i.e., in accordance with the operation of the electric feed pump 24). The feed pressure PF continues increasing until the feed pressure PF reaches the regulator set pressure P1 of the pressure regulator 25, and is maintained at the regulator set pressure P1 thereafter.

As described above, the standby time TA is set to the driving time of the electric feed pump 24 during which the feed pressure PF can be reliably increased to the regulator set pressure P1. Therefore, after time t2 when the standby time TA has elapsed from time t1, it is apparent that the feed pressure PF is the regulator set pressure P1 without the necessity of depending on the result of detection performed by the low-pressure side fuel pressure sensor 30.

In the present embodiment, the electric feed pump 24 is driven such that the fuel discharge rate is the maximum value. Accordingly, the feed pressure PF can be increased to the regulator set pressure P1 quickly, the standby time TA can be reduced, and the diagnosis time can be reduced.

In the present embodiment, the diagnosis portion 35 repeatedly reads the output voltage Vpf of the low-pressure side fuel pressure sensor 30 and determines whether the value of the output voltage Vpf is within the normal range at the time intervals TB after time t2. Then, the diagnosis portion 35 counts up the number CD of times of determination each time the determination is performed, and counts up the number CE of times of deviation each time it is determined that the value of the output voltage Vpf is not within the normal range.

As described above, the feed pressure PF at this time is the regulator set pressure P1, and when the low-pressure side fuel pressure sensor 30 normally functions, the output voltage Vpf at this time should have a value (assumed value Vt) corresponding to the regulator set pressure P1. The normal range is set to a range of values within the allowable tolerance β from the assumed value Vt. Therefore, when the low-pressure side fuel pressure sensor 30 normally operates (i.e., normally functions), the output voltage Vpf at this time should have a value within the normal range, and the number CE of times of deviation is not counted up, and only the number CD of times of determination is counted up.

However, for example, in a case where a voltage input to the low-pressure side fuel pressure sensor 30 drops temporarily due to a rapid increase in the amount of electric power used in the hybrid vehicle 10, the output voltage Vpf of the low-pressure side fuel pressure sensor 30 may temporarily fluctuate. Therefore, even if the low-pressure side fuel pressure sensor 30 normally functions, the output voltage Vpf at this time may temporarily have a value that deviates from the normal range. In an example in which the low-pressure side fuel pressure sensor 30 normally functions, that is, in an example indicated by the solid line in FIG. 6, the output voltage Vpf temporarily deviates from the normal range at time t2, and as a result, the number CE of times of deviation is counted up.

However, such a fluctuation of the output voltage Vpf does not occur so frequently. The above-described number γ of times for malfunction determination is set to a larger value than an assumed maximum value of the number CE of times of deviation in a period up to the end of the diagnosis, that is, a period until the number CD of times of determination reaches the number ε of times for diagnosis end, when the low-pressure side fuel pressure sensor 30 normally operates. Therefore, in a case where the low-pressure side fuel pressure sensor 30 normally operates (i.e., normally functions), the number CD of times of determination reaches the number ε of times for diagnosis end, before the number CE of times of deviation reaches the number γ of times for malfunction determination. In the example where the low-pressure side fuel pressure sensor 30 normally functions, that is, in the example indicated by the solid line in FIG. 6, the number CD of times of determination reaches the number ε of times for diagnosis end at time t4, and it is determined that the low-pressure side fuel pressure sensor 30 normally functions.

In a case where a malfunction has occurred in the low-pressure side fuel pressure sensor 30, the number CE of times of deviation reaches the number γ of times for malfunction determination before the number CD of times of determination reaches the number ε of times for diagnosis end. In an example where a malfunction has occurred in the low-pressure side fuel pressure sensor 30, that is, in an example indicated by alternate long and two short dashes line in FIG. 6, the number CE of times of deviation reaches the number γ of times for malfunction determination at time t3, and it is determined that a malfunction has occurred in the low-pressure side fuel pressure sensor 30.

When the electric feed pump 24 is driven in a state where the fuel injection is stopped as described above, that is, when fuel is supplied to the low-pressure side fuel supply system 22 in a state where fuel is not consumed, the feed pressure PF can be reliably increased to the regulator set pressure P1. In this situation, by determining whether the output voltage Vpf of the low-pressure side fuel pressure sensor 30 has a value within the normal range, that is, a value corresponding to the regulator set pressure P1, it is possible to determine whether a malfunction has occurred such that the value of the feed pressure PF detected by the low-pressure side fuel pressure sensor 30 deviates from an actual value, in other words, it is possible to perform a so-called rationality diagnosis.

As described above, the output voltage Vpf of the low-pressure side fuel pressure sensor 30 may temporality fluctuate due to, for example, a rapid increase in the electric power consumption of the hybrid vehicle 10. Due to the fluctuation of the output voltage Vpf, even if the low-pressure side fuel pressure sensor 30 normally functions, the value of the output voltage Vpf that is read in Step S110 and used for determination in Step S111 may deviate from the normal range. Therefore, if the above determination is performed only one time during the diagnosis, the output voltage Vpf at the time when the output voltage Vpf temporarily fluctuates may be reflected on the diagnosis result (in other words, the diagnosis result may be based on the output voltage Vpf at the time when the output voltage Vpf temporarily fluctuates), and accordingly, an erroneous diagnosis may be made (in other words, an erroneous determination as to whether a malfunction has occurred in the low-pressure side fuel pressure sensor 30 may be made). In the present embodiment, the diagnosis portion 35 determines whether a malfunction has occurred in the low-pressure side fuel pressure sensor 30 based on the results of the determination performed a plurality of times, and therefore, it is possible to reduce the possibility that the erroneous diagnosis (i.e., the erroneous determination as to whether a malfunction has occurred in the low-pressure side fuel pressure sensor 30) is made due to the temporary fluctuation of the output voltage Vpf.

Further, as described above, the diagnosis on the low-pressure side fuel pressure sensor 30 in the present embodiment is performed by driving the electric feed pump 24 during the electric traveling of the hybrid vehicle 10. Since there is no engine sound during the electric traveling and the electric feed pump 24 is stopped except for during the diagnosis, an occupant may feel a sense of discomfort due to the driving sound of the electric feed pump 24 when the electric feed pump 24 is driven for the diagnosis. In the present embodiment, the electric feed pump 24 is driven for the diagnosis on the condition that the traveling speed SPD is equal to or higher than the diagnosis implementation speed $\alpha$, and the background noise due to the traveling of the vehicle, such as a wind noise or road noise, is larger than the driving sound of the electric feed pump 24. Therefore, the driving sound of the electric feed pump 24 due to the diagnosis is unlikely to be noticeable, and an occupant is unlikely to feel a sense of discomfort.

The feed pressure PF drops each time fuel injection is performed by each port injection valve 20 during the operation of the engine 11. Therefore, if the diagnosis is performed during the operation of the engine 11, the feed pressure PF in the period, during which the above-described determination is performed, is not stably maintained at the regulator set pressure P1, and thus, diagnostic accuracy deteriorates.

The fuel injection is stopped during the fuel cutoff in the engine as well as during the electric traveling. However, if the same diagnosis is performed during the fuel cutoff, the following problems may occur. First, in the hybrid vehicle 10 that performs the above-described electric traveling, a frequency with which the fuel cutoff is performed in the engine 11 is low, and the opportunity of performing the diagnosis is limited. If the rotational speed of the engine 11 extremely decreases during the fuel cutoff, combustion cannot be performed when the fuel cutoff is stopped and the fuel injection is restarted, and thus, engine stall occurs. Therefore, it is necessary to maintain the engine speed at a given speed or higher, even during the fuel cutoff. As a result, during the fuel cutoff, part of power from the second generator motor 13 is used for maintaining the engine speed. Thus, the energy efficiency of the hybrid vehicle 10 is higher in a case where the rotation of the engine 11 is stopped and the traveling is switched to the electric traveling. Therefore, in the hybrid vehicle 10 that can perform the electric traveling, the frequency, with which the fuel cutoff is performed, is low. Thus, if the diagnosis on the low-pressure side fuel pressure sensor 30 is performed during the fuel cutoff, the opportunity of performing this diagnosis is limited. Therefore, in the hybrid vehicle 10 that performs the electric traveling, the opportunity of performing the diagnosis can be secured more easily in a case where the diagnosis is performed during the electric traveling than in a case where the diagnosis is performed during the fuel cutoff.

If the hybrid vehicle 10 is restrained from performing the electric traveling until the diagnosis is completed, it is possible to secure the opportunity of performing the diagnosis, even in a case where the diagnosis is performed during the fuel cutoff. However, in such a case, the electric traveling with better energy efficiency is replaced with the fuel cutoff with worse energy efficiency until the completion of the diagnosis, and therefore, the energy efficiency of the hybrid vehicle 10 deteriorates.

Further, there is also the following problem in the case where the diagnosis is performed during the fuel cutoff. During the fuel cutoff, the exhaust gas that flows through an exhaust passage of the engine 11 is replaced with fresh air, and therefore, there is a good opportunity for performing the rationality diagnosis on an air-fuel ratio sensor or an oxygen sensor that outputs a signal according to the oxygen excess/shortage percentage in the exhaust gas. That is, it is possible to determine whether a malfunction has occurred in the air-fuel ratio sensor and/or the oxygen sensor by determining whether the output of the air-fuel ratio sensor and/or the oxygen sensor during the fuel cutoff has a value corresponding to the fresh air.

In the diagnosis on the low-pressure side fuel pressure sensor 30, if the feed pressure PF is maintained at the regulator set pressure P1 in a state where the fuel injection is stopped, fuel may leak out from the port injection valves 20. In such a case, since the leaked-out fuel is mixed with intake air, the air inside the exhaust passage may not be fresh air. Therefore, the diagnosis on the low-pressure side fuel pressure sensor 30 and the diagnosis on the air-fuel ratio sensor and/or the oxygen sensor are not performed simultaneously. If the diagnosis on the low-pressure side fuel pressure sensor 30 is performed during the fuel cutoff, the opportunity of the fuel cutoff performed with a low frequency needs to be shared by both the diagnoses. In contrast, during the electric traveling, there is no competition with the diagnosis on the air-fuel ratio sensor and/or the oxygen sensor, and thus, it is possible to easily secure the opportunity of performing the diagnosis on the low-pressure side fuel pressure sensor 30.

Moreover, there is also the following problem in the case where the diagnosis is performed during the fuel cutoff. Even during the fuel cutoff, the rotation of the engine 11 is continued and the reciprocating operation of the plunger 31*a* of the high-pressure fuel pump 31 is continued. Therefore, even if energization of the electromagnetic spill valve 31*c* is stopped and the fuel discharge of the high-pressure fuel pump 31 is stopped, the flow of the fuel into the pressurizing chamber 31*b* of the high-pressure fuel pump 31 and the returning flow of the fuel to the low-pressure fuel passage 28 are continued. Then, pulsation occurs in the feed pressure PF due to the flow of the fuel and the returning flow of the fuel caused by the high-pressure fuel pump 31. Therefore, if the diagnosis on the low-pressure side fuel pressure sensor 30 is performed during the fuel cutoff, the diagnostic accuracy may deteriorate due to the influence of the pulsation of the feed pressure PF caused by the operation of the high-pressure fuel pump 31. In contrast, during the electric traveling, the rotation of the engine 11 is stopped, and the reciprocating operation of the plunger 31*a* of the high-pressure fuel pump 31 is also stopped. Accordingly, during the electric traveling, the diagnosis can be performed in a state where there is no pulsation of the feed pressure PF due to the reciprocating operation of the plunger 31*a*, and thus, a more accurate diagnosis can be made (i.e., a more accurate determination can be made) as compared to a case where the diagnosis is performed during the fuel cutoff.

When the hybrid vehicle 10 is in a soak state, that is, when the ignition switch is turned off, the fuel injection is stopped. However, when the hybrid vehicle 10, which has traveled, is brought to the soak state, the environmental temperature around the low-pressure side fuel supply system 22 may change rapidly, and the rapid change may occur also in the temperature of the fuel within the low-pressure side fuel supply system 22. Therefore, if the same diagnosis on the low-pressure side fuel pressure sensor 30 as in the present embodiment is performed when the hybrid vehicle 10 is in the soak state, it may not be possible to make an accurate diagnosis (in other words, it may not be possible to make an accurate determination) due to the influence of the thermal expansion/contraction of the fuel caused by the temperature change.

For example, in a case where the hybrid vehicle 10 is parked indoors after traveling outdoors in the intense cold, if the room temperature of a parking place is higher than the outside air temperature, the feed pressure PF increases due to the thermal expansion of the fuel within the low-pressure side fuel supply system 22 after the parking. The increase in the feed pressure PF in this case may become more rapid than the increase in the feed pressure PF in response to the fuel supply by the electric feed pump 24, and therefore, the pressure regulator 25 may not be able to sufficiently decrease the feed pressure PF increased due to the thermal expansion of the fuel. Accordingly, the feed pressure PF may be increased to exceed the regulator set pressure P1. In a case where the diagnosis is performed in this state, even if the low-pressure side fuel pressure sensor 30 normally operates, the output voltage Vpf during the diagnosis becomes higher than the upper limit of the normal range, and it may be erroneously determined that a malfunction has occurred in the low-pressure side fuel pressure sensor 30.

In a case where the room temperature of the parking place is lower than the outside air temperature, thermal contraction occurs in the fuel within the low-pressure side fuel supply system 22 after the parking, and the feed pressure PF drops. If the diagnosis is performed in this state, there is a possibility that the feed pressure PF cannot be increased to the regulator set pressure P1 by driving the electric feed pump 24 for the standby time TA. Accordingly, it may not be possible to make an accurate diagnosis (in other words, it may not be possible to make an accurate determination).

In contrast, during the electric traveling, the environmental temperature around the low-pressure side fuel supply system 22 is unlikely to rapidly change. Therefore, it is possible to make a more accurate diagnosis during the electric traveling than when the hybrid vehicle 10 is in the soak state.

The above embodiment may be changed and implemented as follows. In the above embodiment, the diagnosis on the low-pressure side fuel pressure sensor 30 is performed by driving the electric feed pump 24 on the condition that the traveling speed SPD is equal to or higher than the diagnosis implementation speed $\alpha$ during the electric traveling of the hybrid vehicle 10. However, this diagnosis may be performed irrespective of the traveling speed SPD. Even in this case, by employing the electric feed pump 24 with a small driving sound, it is possible to reduce the possibility that an occupant feels a sense of discomfort due to the driving sound of the electric feed pump 24 during the diagnosis.

In the above embodiment, the electric feed pump 24 is driven such that the amount of electric power supplied to the electric feed pump 24 is the maximum amount during the diagnosis. However, the amount of electric power supplied to the electric feed pump 24 during the diagnosis may be smaller than the maximum amount. In this case, since the driving sound of the electric feed pump 24 is decreased, it is possible to alleviate or abolish the restriction on the driving of the electric feed pump 24 based on the traveling speed SPD for suppressing the discomfort caused by the driving sound during the diagnosis. In this case, the opportunity of performing the diagnosis increases further.

In the above embodiment, the amount of electric power supplied to the electric feed pump 24 before the standby time TA elapses is the same as that after the standby time TA elapses. Before the standby time TA elapses, it is required to increase the fuel discharge flow rate of the electric feed pump 24 in an allowable range in order to increase the feed pressure PF to the regulator set pressure P1 promptly. However, after the standby time TA elapses, the discharge flow rate does not need to be so large, as long as the feed pressure PF can be maintained at the regulator set pressure P1. Therefore, the amount of electric power supplied to the electric feed pump 24 after the standby time TA elapses may be smaller than that before the standby time TA elapses. In a case where the feed pressure PF can be maintained at the regulator set pressure P1 even if the electric feed pump 24 is stopped, the driving of the electric feed pump 24 may be stopped when the standby time TA has elapsed.

In the above embodiment, if the electric traveling ends while the diagnosis is being performed, the diagnosis is restarted from the beginning by discarding the result of determination (hereinafter, referred to as output determination) as to whether the output voltage Vpf until then has a value within the normal range. In this case, if the electric traveling with a short duration time continues, the diagnosis is restarted many times. In this regard, even if the electric traveling ends while the diagnosis is being performed, the number CD of times of determination and the number CE of times of deviation at that time may be maintained and taken over at the time of the next electric traveling.

In the above embodiment, in a case where the number CD of times of determination reaches the number $\varepsilon$ of times for diagnosis end before the number CE of times of deviation reaches the number $\gamma$ of times for malfunction determination, it is determined that the low-pressure side fuel pressure sensor 30 normally functions, and in a case where the number CE of times of deviation reaches the number $\gamma$ of times for malfunction determination before the number CD of times of determination reaches the number $\varepsilon$ of times for diagnosis end, it is determined that a malfunction has occurred in the low-pressure side fuel pressure sensor 30. However, the manner in which a diagnosis is made may be changed appropriately. For example, the output determination may be performed without fixing the upper limit of the number of times, and it may be determined whether a malfunction has occurred in the low-pressure side fuel pressure sensor 30, by determining whether the ratio of the number CE of times of deviation to the number CD of times of determination is less than a prescribed value. In this case as well, since the diagnosis is performed on the basis of the results of the output determination performed a plurality of times, it is possible to reduce an erroneous diagnosis (i.e., an erroneous determination as to whether a malfunction has occurred in the low-pressure side fuel pressure sensor 30) caused by a temporary fluctuation of the output voltage Vpf.

In the above embodiment, the output determination is performed using a current value (instantaneous value) of the output voltage Vpf. However, the output determination may be performed using an average value or a smoothened value of the output voltage Vpf in a given period. In this case, even if the number of times of the output determination is small, it is possible to reduce an erroneous diagnosis caused by a temporary fluctuation of the output voltage Vpf.

In the above embodiment, it is determined whether a malfunction has occurred in the low-pressure side fuel pressure sensor 30, based on the results of the output determination performed a plurality of times. However, it may be determined whether a malfunction has occurred in the low-pressure side fuel pressure sensor 30, based on the result of the output determination performed once. In the above embodiment, in Step S112 in the flowchart of the diagnosis processing in FIG. 5, the output determination is performed using the output voltage Vpf of the low-pressure side fuel pressure sensor 30. However, the output determination may be performed using a pressure value detected by the low-pressure side fuel pressure sensor 30 instead of the output voltage Vpf. The detected pressure value herein is a value obtained by converting the output voltage Vpf to a pressure corresponding to this output voltage Vpf in accordance with the output characteristics of the low-pressure side fuel pressure sensor 30 at the time when the low-pressure side fuel pressure sensor 30 normally functions. Thus, the detected pressure value is a value that is substantially the same as the output voltage Vpf. Even in this case, if the low-pressure side fuel pressure sensor 30 normally functions, the pressure value detected by the low-pressure side fuel pressure sensor 30 at the time of the output determination should be the regulator set pressure P1. Therefore, if the range of values within a tolerance from the regulator set pressure P1 is set to the normal range, it is possible to perform the output determination, using the pressure value detected by the low-pressure side fuel pressure sensor 30 as the output of the low-pressure side fuel pressure sensor 30.

In a case where the electrically-operated fuel pump is employed as the high-pressure fuel pump 31, it is possible to drive the high-pressure fuel pump 31 even when the hybrid vehicle 10 performs electric traveling in a state in which the rotation of the engine 11 is stopped. In this case, it is also possible to apply the same diagnosis processing as that implemented by the diagnosis portion 35 in the above embodiment, to the diagnosis on the high-pressure side fuel pressure sensor 33. In this case, in a state where the rotation of the engine 11 is stopped and the fuel injection of the in-cylinder injection valves 21 is stopped during the electric traveling, both of the electric feed pump 24 and the electrically-operated high-pressure fuel pump 31 are driven, and the diagnosis on the high-pressure side fuel pressure sensor 33 is performed. In this case, when both of the electric feed pump 24 and the electrically-operated high-pressure fuel pump 31 are driven, the fuel pressure within the high-pressure side delivery pipe 32 is increased until the fuel pressure reaches a relief pressure of the relief valve 34, and is maintained at this relief pressure thereafter. Therefore, it may be determined whether the output (the output voltage or the detected pressure value) of the high-pressure side fuel pressure sensor 33 at this time is within the allowable tolerance from the relief pressure, and it may be determined whether a malfunction has occurred in the high-pressure side fuel pressure sensor 33 based on the result of the above-described determination. In this case, the electrically-operated fuel supply device is constituted by both of the electric feed pump 24 and the electrically-operated high-pressure fuel pump. Further, in this case, the relief valve 34 may be regarded as the pressure-regulating unit configured to maintain the pressure (the fuel pressure within the high-pressure side delivery pipe 32) of the fuel supplied to the in-cylinder injection valves 21 to the relief pressure or lower, the relief pressure being the prescribed upper limit pressure.

The diagnosis processing for the low-pressure side fuel pressure sensor 30 performed by the diagnosis portion 35 in the fuel pressure sensor diagnosis device of the above embodiment can also be applied to the diagnosis on a fuel pressure sensor that is provided in a fuel supply system for an engine, which does not include the high-pressure side fuel supply system 23 and includes only the low-pressure side fuel supply system 22.

What is claimed is:

1. A fuel pressure sensor diagnosis device configured to perform a diagnosis on a fuel pressure sensor provided in a fuel supply system including a fuel supply pump configured to be driven with use of electric power to supply fuel to a fuel injection valve of an engine, and a pressure regulator configured to maintain a fuel supply pressure at or below a prescribed upper limit pressure, the fuel supply pressure being a pressure of the fuel supplied to the fuel injection valve by the fuel supply pump, the fuel pressure sensor being configured to detect the fuel supply pressure, the engine being mounted on a hybrid vehicle including the engine and a motor as power sources for causing the hybrid vehicle to travel, and configured to perform electric traveling with use of power from the motor in a state where rotation of the engine is stopped, the fuel pressure sensor diagnosis device comprising an electronic control unit configured to: (i) drive the fuel supply pump during the electric traveling of the hybrid vehicle, (ii) while the rotation of the engine is stopped, perform a determination as to whether an output of the fuel pressure sensor is within a normal range after driving of the fuel supply pump has started during the electric traveling of the hybrid vehicle, and (iii) perform the diagnosis to determine whether a malfunction has occurred in the fuel pressure sensor based on a result of the determination, the normal range being an assumed range of the output of the fuel pressure sensor in a case where the fuel pressure sensor functions normally and the fuel supply pressure is the prescribed upper limit pressure.

2. The fuel pressure sensor diagnosis device according to claim 1, wherein the electronic control unit is configured to drive the fuel supply pump for the diagnosis on a condition that a traveling speed of the hybrid vehicle is equal to or higher than a prescribed value.

3. The fuel pressure sensor diagnosis device according to claim 1, wherein the electronic control unit is configured to perform the diagnosis to determine whether the malfunction has occurred in the fuel pressure sensor, based on results of the determination performed a plurality of times.

4. The fuel pressure sensor diagnosis device according to claim 3, wherein the electronic control unit is configured to: (a) perform the determination at prescribed time intervals after the driving of the fuel supply pump has started, (b) determine that the malfunction has occurred in the fuel pressure sensor in a case where a number of times of deviation reaches a prescribed number of times for malfunction determination before a number of times of performing the determination reaches a prescribed number of times, and (c) determine that the fuel pressure sensor functions normally in a case where the number of times of performing the determination reaches the prescribed number of times before the number of times of deviation reaches the prescribed number of times for malfunction determination, the number of times of deviation being the number of times the electronic control unit has determined that the output of the fuel pressure sensor is not within the normal range.

* * * * *